US008542558B2

(12) United States Patent
Tokiwa et al.

(10) Patent No.: US 8,542,558 B2
(45) Date of Patent: Sep. 24, 2013

(54) TIME INFORMATION ACQUIRING APPARATUS AND RADIO CONTROLLED TIMEPIECE

(75) Inventors: Teruhisa Tokiwa, Kunitachi (JP); Takashi Sano, Fussa (JP)

(73) Assignee: Casio Computer Co., Ltd, Tokyo (JP)

( * ) Notice: Subject to any disclaimer, the term of this patent is extended or adjusted under 35 U.S.C. 154(b) by 193 days.

(21) Appl. No.: 13/174,907

(22) Filed: Jul. 1, 2011

(65) Prior Publication Data

US 2012/0008466 A1 Jan. 12, 2012

(30) Foreign Application Priority Data

Jul. 6, 2010 (JP) ..... 2010-153518

(51) Int. Cl.
*G04C 11/00* (2006.01)

(52) U.S. Cl.
USPC ..... 368/47

(58) Field of Classification Search
USPC ..... 368/47
See application file for complete search history.

(56) References Cited

U.S. PATENT DOCUMENTS

| | | | | |
|---|---|---|---|---|
| 3,684,964 | A * | 8/1972 | Bright et al. | 375/316 |
| 7,042,808 | B2 * | 5/2006 | Saitoh | 368/47 |
| 7,133,424 | B2 * | 11/2006 | Becker et al. | 370/514 |
| 8,264,915 | B2 * | 9/2012 | Abe et al. | 368/47 |
| 8,379,490 | B2 * | 2/2013 | Abe et al. | 368/47 |
| 2005/0195690 | A1 | 9/2005 | Kondo | |
| 2006/0050824 | A1 | 3/2006 | Kondo | |
| 2006/0140282 | A1 * | 6/2006 | Kondo | 375/242 |
| 2008/0240076 | A1 | 10/2008 | Someya | |
| 2009/0248357 | A1 | 10/2009 | Abe | |
| 2009/0323478 | A1 | 12/2009 | Someya | |

FOREIGN PATENT DOCUMENTS

| | | | |
|---|---|---|---|
| EP | 1 662 344 | A2 | 5/2006 |
| EP | 1 855 167 | A2 | 11/2007 |
| JP | 11-304973 | | 11/1999 |
| JP | 2002-286882 | | 10/2002 |
| JP | 2003-222687 | | 8/2003 |
| JP | 2006-071318 | | 3/2006 |
| JP | 2006-090770 | | 4/2006 |
| JP | 2008-241351 | | 10/2008 |
| JP | 2010-008324 | | 1/2010 |
| JP | 2010-025651 | | 2/2010 |

OTHER PUBLICATIONS

Extended European Search Report for European Application No. 11172724A-1240/2405315 mailed on Feb. 13, 2012.
Japanese Office Action for Japanese Application No. 2010-167837 mailed on May 8, 2012.
Extended European Search Report for European Application No. 11175357.0-1240 dated May 10, 2012.

* cited by examiner

*Primary Examiner* — Sean Kayes
(74) *Attorney, Agent, or Firm* — Turocy & Watson, LLP

(57) ABSTRACT

A time information acquiring apparatus for acquiring time information from a time code signal included in a standard radio waver including: a pulse measuring section which detects a matching level of an individual pulse signal constituting the time code signal to a predetermined code value; a grouping section which groups pulse signals into one group; a code string estimating section which estimates a code string having a possibility of emerging in a portion of the group in a frame of the time code signal; a code string determining section which determines a probability that the code string indicated by the grouped pulse signals corresponds to the estimated code string based on the matching level; and a time information generating section which generates the time information based on the code string for which the code string determining section determines that the probability is high.

10 Claims, 19 Drawing Sheets

| UNITS DIGIT OF MINUTES, DETERMINATION PATTERN OF BCD VALUE | | | | TOTAL VALUE OF PROXIMITIES | | |
|---|---|---|---|---|---|---|
| FIRST FRAME OF ONE MINUTE BEFORE | | SECOND FRAME OF THIS TIME | | ONE MINUTE BEFORE | THIS TIME | TOTAL |
| 0 | (0000) | 1 | (0001) | 30 | 30 | 60 |
| 1 | (0001) | 2 | (0010) | 20 | 10 | 30 |
| 2 | (0010) | 3 | (0011) | 20 | 20 | 40 |
| 3 | (0011) | 4 | (0100) | 10 | 10 | 20 |
| 4 | (0100) | 5 | (0101) | 20 | 20 | 40 |
| 5 | (0101) | 6 | (0110) | 10 | 0 | 10 |
| 6 | (0110) | 7 | (0111) | 10 | 10 | 20 |
| 7 | (0111) | 8 | (1000) | 0 | 30 | 30 |
| 8 | (1000) | 9 | (1001) | 40 | 40 | 80 |
| 9 | (1001) | 0 | (0000) | 30 | 20 | 50 |

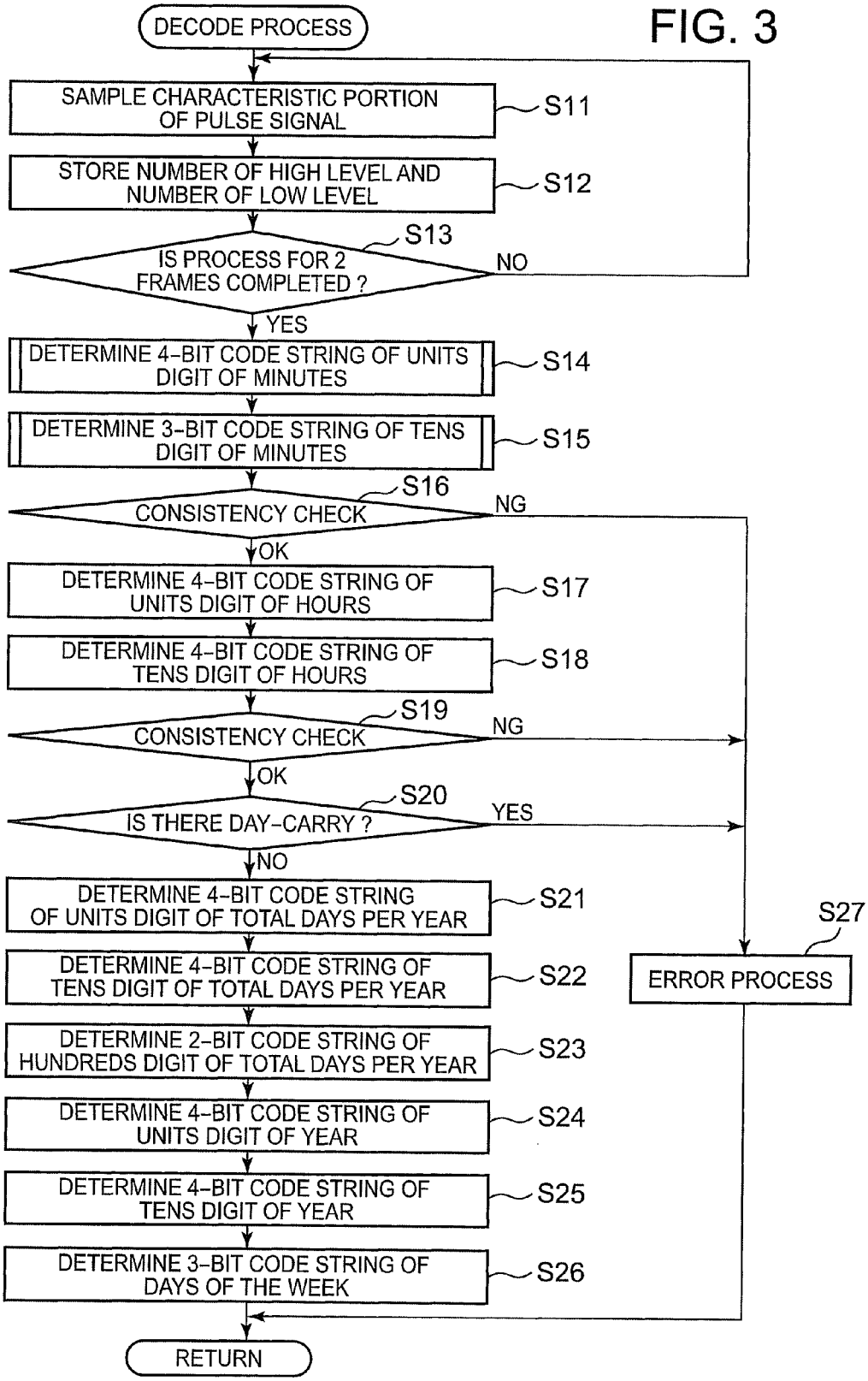
FIG. 3
DECODE PROCESS
SAMPLE CHARACTERISTIC PORTION OF PULSE SIGNAL
S11
STORE NUMBER OF HIGH LEVEL AND NUMBER OF LOW LEVEL
S12
S13
IS PROCESS FOR 2 FRAMES COMPLETED ?
NO
YES
DETERMINE 4-BIT CODE STRING OF UNITS DIGIT OF MINUTES
S14
DETERMINE 3-BIT CODE STRING OF TENS DIGIT OF MINUTES
S15
S16
CONSISTENCY CHECK
NG
OK
DETERMINE 4-BIT CODE STRING OF UNITS DIGIT OF HOURS
S17
DETERMINE 4-BIT CODE STRING OF TENS DIGIT OF HOURS
S18
S19
CONSISTENCY CHECK
NG
OK
S20
IS THERE DAY-CARRY ?
YES
NO
DETERMINE 4-BIT CODE STRING OF UNITS DIGIT OF TOTAL DAYS PER YEAR
S21
S27
DETERMINE 4-BIT CODE STRING OF TENS DIGIT OF TOTAL DAYS PER YEAR
S22
ERROR PROCESS
DETERMINE 2-BIT CODE STRING OF HUNDREDS DIGIT OF TOTAL DAYS PER YEAR
S23
DETERMINE 4-BIT CODE STRING OF UNITS DIGIT OF YEAR
S24
DETERMINE 4-BIT CODE STRING OF TENS DIGIT OF YEAR
S25
DETERMINE 3-BIT CODE STRING OF DAYS OF THE WEEK
S26
RETURN

FIG. 6A

| | UNITS DIGIT OF MINUTES OF FIRST FRAME RECEIVED AT 08 | | | |
|---|---|---|---|---|
| | 8-MINUTE BIT | 4-MINUTE BIT | 2-MINUTE BIT | 1-MINUTE BIT |
| "1" PROXIMITY | 10 | 0 | 0 | 0 |
| "0" PROXIMITY | 0 | 10 | 10 | 10 |

FIG. 6B

| | UNITS DIGIT OF MINUTES OF SECOND FRAME RECEIVED AT 09 | | | |
|---|---|---|---|---|
| | 8-MINUTE BIT | 4-MINUTE BIT | 2-MINUTE BIT | 1-MINUTE BIT |
| "1" PROXIMITY | 10 | 0 | 0 | 10 |
| "0" PROXIMITY | 0 | 10 | 10 | 0 |

FIG. 7

| UNITS DIGIT OF MINUTES, DETERMINATION PATTERN OF BCD VALUE | | | | TOTAL VALUE OF PROXIMITIES | | |
|---|---|---|---|---|---|---|
| FIRST FRAME OF ONE MINUTE BEFORE | | SECOND FRAME OF THIS TIME | | ONE MINUTE BEFORE | THIS TIME | TOTAL |
| 0 | (0000) | 1 | (0001) | 30 | 30 | 60 |
| 1 | (0001) | 2 | (0010) | 20 | 10 | 30 |
| 2 | (0010) | 3 | (0011) | 20 | 20 | 40 |
| 3 | (0011) | 4 | (0100) | 10 | 10 | 20 |
| 4 | (0100) | 5 | (0101) | 20 | 20 | 40 |
| 5 | (0101) | 6 | (0110) | 10 | 0 | 10 |
| 6 | (0110) | 7 | (0111) | 10 | 10 | 20 |
| 7 | (0111) | 8 | (1000) | 0 | 30 | 30 |
| 8 | (1000) | 9 | (1001) | 40 | 40 | 80 |
| 9 | (1001) | 0 | (0000) | 30 | 20 | 50 |

FIG. 8A

| | UNITS DIGIT OF MINUTES OF FIRST FRAME RECEIVED AT 08 | | | |
|---|---|---|---|---|
| | 8-MINUTE BIT | 4-MINUTE BIT | 2-MINUTE BIT | 1-MINUTE BIT |
| "1" PROXIMITY | 8 | 6 | 2 | 8 |
| "0" PROXIMITY | 2 | 4 | 8 | 2 |

FIG. 8B

| | UNITS DIGIT OF MINUTES OF SECOND FRAME RECEIVED AT 09 | | | |
|---|---|---|---|---|
| | 8-MINUTE BIT | 4-MINUTE BIT | 2-MINUTE BIT | 1-MINUTE BIT |
| "1" PROXIMITY | 7 | 1 | 2 | 7 |
| "0" PROXIMITY | 3 | 9 | 8 | 3 |

FIG. 9

| UNITS DIGIT OF MINUTES, DETERMINATION PATTERN OF BCD VALUE | | | | TOTAL VALUE OF PROXIMITIES | | |
|---|---|---|---|---|---|---|
| FIRST FRAME OF ONE MINUTE BEFORE | | SECOND FRAME OF THIS TIME | | ONE MINUTE BEFORE | THIS TIME | TOTAL |
| 0 | (0000) | 1 | (0001) | 16 | 27 | 43 |
| 1 | (0001) | 2 | (0010) | 22 | 17 | 39 |
| 2 | (0010) | 3 | (0011) | 10 | 21 | 31 |
| 3 | (0011) | 4 | (0100) | 16 | 15 | 31 |
| 4 | (0100) | 5 | (0101) | 18 | 19 | 37 |
| 5 | (0101) | 6 | (0110) | 24 | 9 | 33 |
| 6 | (0110) | 7 | (0111) | 12 | 13 | 25 |
| 7 | (0111) | 8 | (1000) | 18 | 27 | 45 |
| 8 | (1000) | 9 | (1001) | 22 | 31 | 53 |
| 9 | (1001) | 0 | (0000) | 28 | 23 | 51 |

FIG. 11

| TENS DIGIT OF MINUTES | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 0 | 1 | ERROR |
| 1 | 2 | ERROR |
| 2 | 3 | ERROR |
| 3 | 4 | ERROR |
| 4 | 5 | ERROR |
| 5 | 0 | ERROR |
| 0 | 0 | ERROR |
| 1 | 1 | ERROR |
| 2 | 2 | ERROR |
| 3 | 3 | ERROR |
| 4 | 4 | ERROR |
| 5 | 5 | ERROR |
| 0 | 1 | 1 |
| 1 | 2 | 2 |
| 2 | 3 | 3 |
| 3 | 4 | 4 |
| 4 | 5 | 5 |
| 5 | 0 | 0 |

| UNITS DIGIT OF MINUTES | | |
|---|---|---|
| DETERMINATION PATTERN OF BCD VALUE | | TIME DEFINITE VALUE |
| ONE MINUTE BEFORE | THIS TIME | |
| 0 | 1 | 1 |
| 1 | 2 | 2 |
| 2 | 3 | 3 |
| 3 | 4 | 4 |
| 4 | 5 | 5 |
| 5 | 6 | 6 |
| 6 | 7 | 7 |
| 7 | 8 | 8 |
| 8 | 9 | 9 |
| 9 | 0 | 0 |

FIG. 12

| TENS DIGIT OF HOURS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 0 | 1 | ERROR |
| 1 | 2 | ERROR |
| 2 | 0 | ERROR |

| UNITS DIGIT OF HOURS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| 0 | 1 | ERROR |
| 1 | 2 | ERROR |
| 2 | 3 | ERROR |
| 3 | 4 | ERROR |
| 4 | 5 | ERROR |
| 5 | 6 | ERROR |
| 6 | 7 | ERROR |
| 7 | 8 | ERROR |
| 8 | 9 | ERROR |
| 9 | 0 | ERROR |
| 3 | 0 | ERROR |

FIG. 13

| | TENS DIGIT OF HOURS | | |
|---|---|---|---|
| | DETERMINATION PATTERN OF BCD VALUE | | TIME DEFINITE VALUE |
| | ONE MINUTE BEFORE | THIS TIME | |
| A | 0 | 0 | 0 |
| | 1 | 1 | 1 |
| | 2 | 2 | 2 |
| B | 0 | 1 | 1 |
| | 1 | 2 | 2 |
| C | 2 | 0 | 0 |

| UNITS DIGIT OF HOURS | | | |
|---|---|---|---|
| DETERMINATION PATTERN OF BCD VALUE | | TIME DEFINITE VALUE | |
| ONE MINUTE BEFORE | THIS TIME | | |
| 0 | 0 | ERROR | |
| 1 | 1 | ERROR | |
| 2 | 2 | ERROR | |
| 3 | 3 | ERROR | |
| 4 | 4 | ERROR | |
| 5 | 5 | ERROR | |
| 6 | 6 | ERROR | |
| 7 | 7 | ERROR | |
| 8 | 8 | ERROR | |
| 9 | 9 | ERROR | |
| 0 | 1 | 1 | a |
| 1 | 2 | 2 | |
| 2 | 3 | 3 | |
| 3 | 4 | 4 | |
| 4 | 5 | 5 | |
| 5 | 6 | 6 | |
| 6 | 7 | 7 | |
| 7 | 8 | 8 | |
| 8 | 9 | 9 | |
| 9 | 0 | 0 | b |
| 3 | 0 | 0 | c |

FIG. 14

| TENS DIGIT OF DAYS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| ~~0~~ | ~~1~~ | ~~ERROR~~ |
| ~~1~~ | ~~2~~ | ~~ERROR~~ |
| ~~2~~ | ~~3~~ | ~~ERROR~~ |
| ~~3~~ | ~~4~~ | ~~ERROR~~ |
| ~~4~~ | ~~5~~ | ~~ERROR~~ |
| ~~5~~ | ~~6~~ | ~~ERROR~~ |
| ~~6~~ | ~~7~~ | ~~ERROR~~ |
| ~~7~~ | ~~8~~ | ~~ERROR~~ |
| ~~8~~ | ~~9~~ | ~~ERROR~~ |
| ~~9~~ | ~~0~~ | ~~ERROR~~ |
| ~~0~~ | ~~0~~ | ~~ERROR~~ |

(JJY, WWVB)

| UNITS DIGIT OF DAYS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| ~~0~~ | ~~1~~ | ~~ERROR~~ |
| ~~1~~ | ~~2~~ | ~~ERROR~~ |
| ~~2~~ | ~~3~~ | ~~ERROR~~ |
| ~~3~~ | ~~4~~ | ~~ERROR~~ |
| ~~4~~ | ~~5~~ | ~~ERROR~~ |
| ~~5~~ | ~~6~~ | ~~ERROR~~ |
| ~~6~~ | ~~7~~ | ~~ERROR~~ |
| ~~7~~ | ~~8~~ | ~~ERROR~~ |
| ~~8~~ | ~~9~~ | ~~ERROR~~ |
| ~~9~~ | ~~0~~ | ~~ERROR~~ |
| ~~5~~ | ~~1~~ | ~~ERROR~~ |
| ~~6~~ | ~~1~~ | ~~ERROR~~ |

(JJY, WWVB)

| HUNDREDS DIGIT OF DAYS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| ~~0~~ | ~~1~~ | ~~ERROR~~ |
| ~~1~~ | ~~2~~ | ~~ERROR~~ |
| ~~2~~ | ~~3~~ | ~~ERROR~~ |
| ~~3~~ | ~~0~~ | ~~ERROR~~ |

(JJY, WWVB)

FIG. 15

| TENS DIGIT OF YEARS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| ~~0~~ | ~~1~~ | ~~ERROR~~ |
| ~~1~~ | ~~2~~ | ~~ERROR~~ |
| ~~2~~ | ~~3~~ | ~~ERROR~~ |
| ~~3~~ | ~~4~~ | ~~ERROR~~ |
| ~~4~~ | ~~5~~ | ~~ERROR~~ |
| ~~5~~ | ~~6~~ | ~~ERROR~~ |
| ~~6~~ | ~~7~~ | ~~ERROR~~ |
| ~~7~~ | ~~8~~ | ~~ERROR~~ |
| ~~8~~ | ~~9~~ | ~~ERROR~~ |
| ~~9~~ | ~~0~~ | ~~ERROR~~ |

| UNITS DIGIT OF YEARS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| ~~0~~ | ~~1~~ | ~~ERROR~~ |
| ~~1~~ | ~~2~~ | ~~ERROR~~ |
| ~~2~~ | ~~3~~ | ~~ERROR~~ |
| ~~3~~ | ~~4~~ | ~~ERROR~~ |
| ~~4~~ | ~~5~~ | ~~ERROR~~ |
| ~~5~~ | ~~6~~ | ~~ERROR~~ |
| ~~6~~ | ~~7~~ | ~~ERROR~~ |
| ~~7~~ | ~~8~~ | ~~ERROR~~ |
| ~~8~~ | ~~9~~ | ~~ERROR~~ |
| ~~9~~ | ~~0~~ | ~~ERROR~~ |

FIG. 16

| DIGIT OF DAY OF WEEK | | |
|---|---|---|
| DETERMINATION PATTERN OF BCD VALUE | | DEFINITE VALUE OF DAY OF WEEK |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| ~~0~~ | ~~1~~ | ~~ERROR~~ |
| ~~1~~ | ~~2~~ | ~~ERROR~~ |
| ~~2~~ | ~~3~~ | ~~ERROR~~ |
| ~~3~~ | ~~4~~ | ~~ERROR~~ |
| ~~4~~ | ~~5~~ | ~~ERROR~~ |
| ~~5~~ | ~~6~~ | ~~ERROR~~ |
| ~~6~~ | ~~0~~ | ~~ERROR~~ |

(JJY, MSF)

FIG. 17

| TENS DIGIT OF DAYS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| ~~0~~ | ~~1~~ | ~~ERROR~~ |
| ~~1~~ | ~~2~~ | ~~ERROR~~ |
| ~~2~~ | ~~3~~ | ~~ERROR~~ |
| ~~2~~ | ~~0~~ | ~~ERROR~~ |
| ~~3~~ | ~~0~~ | ~~ERROR~~ |

(DCF, MSF)

| UNITS DIGIT OF DAYS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| ~~0~~ | ~~1~~ | ~~ERROR~~ |
| ~~1~~ | ~~2~~ | ~~ERROR~~ |
| ~~2~~ | ~~3~~ | ~~ERROR~~ |
| ~~3~~ | ~~4~~ | ~~ERROR~~ |
| ~~4~~ | ~~5~~ | ~~ERROR~~ |
| ~~5~~ | ~~6~~ | ~~ERROR~~ |
| ~~6~~ | ~~7~~ | ~~ERROR~~ |
| ~~7~~ | ~~8~~ | ~~ERROR~~ |
| ~~8~~ | ~~9~~ | ~~ERROR~~ |
| ~~9~~ | ~~0~~ | ~~ERROR~~ |
| ~~8~~ | ~~1~~ | ~~ERROR~~ |
| ~~9~~ | ~~1~~ | ~~ERROR~~ |

(DCF, MSF)

FIG. 18

| TENS DIGIT OF MONTHS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| ~~0~~ | ~~1~~ | ~~ERROR~~ |
| ~~1~~ | ~~0~~ | ~~ERROR~~ |

(DCF, MSF)

| UNITS DIGIT OF MONTHS | | |
|---|---|---|
| DETERMINATION PATTERN OF BCD VALUE | | TIME DEFINITE VALUE |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| ~~0~~ | ~~1~~ | ~~ERROR~~ |
| ~~1~~ | ~~2~~ | ~~ERROR~~ |
| ~~2~~ | ~~3~~ | ~~ERROR~~ |
| ~~3~~ | ~~4~~ | ~~ERROR~~ |
| ~~4~~ | ~~5~~ | ~~ERROR~~ |
| ~~5~~ | ~~6~~ | ~~ERROR~~ |
| ~~6~~ | ~~7~~ | ~~ERROR~~ |
| ~~7~~ | ~~8~~ | ~~ERROR~~ |
| ~~8~~ | ~~9~~ | ~~ERROR~~ |
| ~~9~~ | ~~0~~ | ~~ERROR~~ |
| ~~2~~ | ~~1~~ | ~~ERROR~~ |

(DCF, MSF)

FIG. 19

| DIGIT OF DAY OF WEEK | | |
|---|---|---|
| DETERMINATION PATTERN OF BCD VALUE | | DEFINITE VALUE OF DAY OF WEEK |
| ONE MINUTE BEFORE | THIS TIME | |
| 0 | 0 | 0 |
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| ~~1~~ | ~~2~~ | ~~ERROR~~ |
| ~~2~~ | ~~3~~ | ~~ERROR~~ |
| ~~3~~ | ~~4~~ | ~~ERROR~~ |
| ~~4~~ | ~~5~~ | ~~ERROR~~ |
| ~~5~~ | ~~6~~ | ~~ERROR~~ |
| ~~6~~ | ~~7~~ | ~~ERROR~~ |
| ~~7~~ | ~~1~~ | ~~ERROR~~ |

(DCF)

TIME INFORMATION ACQUIRING APPARATUS AND RADIO CONTROLLED TIMEPIECE

BACKGROUND OF THE INVENTION

The present invention relates to a time information acquiring apparatus which acquires time information from a time code signal included in a standard radio wave (standard time and frequency signal), and a radio controlled timepiece provided with the time information acquiring apparatus.

BACKGROUND ART

Conventionally, when time information is acquired from a time code signal included in a standard radio wave, it is general that each of a plurality of pulse signals constituting the time code signal is determined to indicate either one of codes, and the time information is generated based on a series of determined codes (e.g., see Japanese Patent Application Laid-Open Publication No. 2008-241351, which corresponds to US2008/0240076A1).

In the conventional general method for determining the code of the time code signal, a code determination is performed for individual pulse signal of the time code signal. Therefore, when the time code signal is temporarily contaminated with a lot of noise, there is a high possibility that the code at the portion, among the series of the determined codes, which is greatly contaminated with noise is erroneously determined. When some codes are erroneously determined, an error is caused in a consistency check. This entails a problem that a process of receiving the standard radio wave has to be repeated, or erroneous time information might be generated.

An object of the present invention is to provide a time information acquiring apparatus and a radio controlled timepiece which have high resistance to temporal noise contamination, and which can acquire correct time information from a time code signal.

SUMMARY OF THE INVENTION

According to one aspect of the present invention, there is provided a time information acquiring apparatus for acquiring time information from a time code signal included in a standard radio wave, including: a pulse measuring section which detects a matching level of an individual pulse signal constituting the time code signal to a predetermined code value; a grouping section which groups a plurality of pulse signals included in the time code signal into one group a code string estimating section which estimates a code string having a possibility of emerging in a portion of the group in a frame of the time code signal; a code string determining section which determines a probability that the code string indicated by the grouped pulse signals corresponds to the estimated code string based on the matching level; and a time information generating section which generates the time information based on the code string for which the code string determining section determines that the probability is high.

BRIEF DESCRIPTION OF THE DRAWINGS

FIG. 3 is a flowchart showing a detailed decode process to be executed in step S6 in FIG. 2;

FIGS. 6A and 6B are tables showing proximities to pulse signals of 0 code and 1 code with respect to 4-bit-indicated units digits of minutes in an ideal time code signal having no noise, wherein FIG. 6A shows a case of a first frame received and transmitted at time of x:08, while FIG. 6B shows a case of a second frame received and transmitted at time of x:09;

FIG. 7 is a table showing determination patterns of code strings of a group of units digits of minutes, and total values based on the degrees of proximities in FIGS. 6A and 6B;

FIGS. 8A and 8B are tables showing proximities to pulse signals of 0 code and 1 code with respect to 4-bit-indicated units digits of minutes in a time code signal having noise contamination, wherein FIG. 8A shows a case of a first frame received and transmitted at time of x:08, while FIG. 8B shows a case of the second frame received and transmitted at time of x:09;

FIG. 9 is a table showing determination patterns of code strings of a group of units digits of minutes, and total values based on the degrees of proximities in FIGS. 8A and 8B;

FIG. 11 is a diagram for explaining a relationship between the determination patterns of a group of tens digits of minutes and the determination patterns of the group of units digits of minutes;

FIG. 12 is a diagram for explaining a first aspect of a relationship between the determination patterns of a group of tens digits of hours and the determination patterns of a group of units digits of hours;

FIG. 13 is a diagram for explaining a second aspect of a relationship between the determination patterns of the group of tens digits of hours and the determination patterns of the group of units digits of hours;

FIG. 14 is a diagram for explaining a relationship among the determination patterns of a group of hundreds digits of days, the determination patterns of a group of tens digits of days, and the determination patterns of a group of units digits of days;

FIG. 15 is a diagram for explaining a relationship between the determination patterns of a group of tens digits of years and the determination patterns of a group of units digits of years;

FIG. 16 is a table showing determination patterns of a group of digits of days of the week;

FIG. 17 is a diagram for explaining a relationship between determination patterns of a group of tens digits of days and determination patterns of a group of units digits of days corresponding to the German time code and the British time code;

FIG. 18 is a diagram for explaining a relationship between determination patterns of a group of tens digits of months and determination patterns of a group of units digits of months corresponding to the German time code and the British time code;

FIG. 19 is a table showing determination patterns of the group of digits of days of the week corresponding to the German time code;

DETAILED DESCRIPTION OF THE PREFERRED EMBODIMENTS

Figure 1:
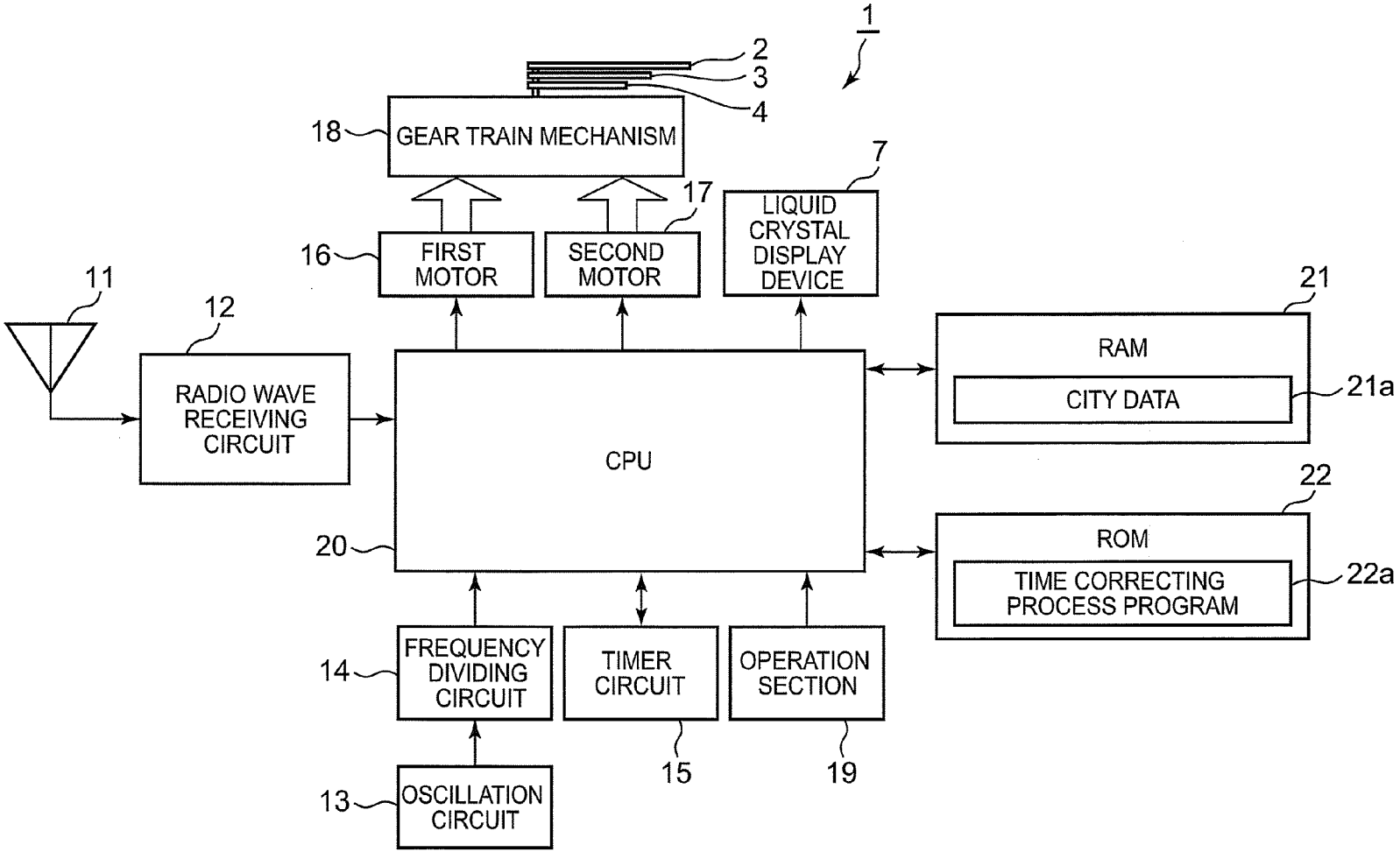
FIG. 1 is a block diagram showing an overall configuration of a radio controlled timepiece according to an embodiment of the present invention.

Embodiments of the present invention will be described below with reference to the drawings. FIG. 1 is a block diagram showing an overall configuration of a radio controlled timepiece 1 according to the embodiment of the present invention.

The radio controlled timepiece 1 of the embodiment is an electronic timepiece which has a function to receive a standard radio wave (standard time and frequency signal) including a time code to automatically correct a time. The radio controlled timepiece 1 displays a time by hands (second hand 2, minute hand 3, and hour hand 4) rotating on a face, and by a liquid crystal display device 7 which is exposed on the face to make various displays.

As shown in FIG. 1, the radio controlled timepiece 1 also includes: an antenna 11 which receives a standard radio wave; a radio wave receiving circuit (radio wave receiving section) 12 which demodulates the standard radio wave to generate a time code signal; an oscillation circuit 13 and a frequency dividing circuit 14 which generate various timing signals; a timer circuit (timer section) 15 which counts the time; a first motor 16 which drives the second hand 2 to rotate; a second motor 17 which drives the minute hand 3 and the hour hand 4 to rotate; a gear train mechanism 18 which transmits rotational driving forces of the first motor 16 and the second motor 17 to the corresponding hands; an operation section 19 which has a plurality of operation buttons and to which an operation command is inputted from the outside, a CPU (central processing section) 20 which makes an overall control of the apparatus, a RAM (Random Access Memory) 21 which provides a working memory space to the CPU 20, and a ROM (Read Only Memory) 22 which stores various control data pieces and control programs.

The radio wave receiving circuit 12 includes: an amplifying section which amplifies a signal received by the antenna 11; a filter section which extracts only a frequency component corresponding to the standard radio wave from the received signals; a demodulating section which demodulates the received signal whose amplitude is modulated to extract the time code signal; and a comparator which performs a wave shaping such that the demodulated time code signal is made into a signal of high-level and low-level to output the signal to the outside. Although not particularly limited, the radio wave receiving circuit 12 has a low-active output configuration in which the output becomes a low level when the amplitude of the standard radio wave is large, while the output becomes a high level when the amplitude of the standard radio wave is small.

The frequency dividing circuit 14 can change the frequency-dividing ratio into various values on receipt of the command from the CPU 20. The frequency dividing circuit 14 also has a configuration capable of providing parallel outputs of a plurality of types of timing signals to the CPU 20. For example, the frequency dividing circuit 14 generates a timing signal of 1-second period to feed the generated timing signal to the CPU 20 in order to update timer data of the counting circuit 15 in 1-second periods, while generating a timing signal of a sampling frequency to feed the generated timing signal to the CPU 20 when taking the time code signal outputted from the radio wave receiving circuit 12.

The first motor 16 and the second motor 17 are stepping motors. The first motor 16 stepwisely drives the second hand 2, and the second motor 17 stepwisely drives the minute hand 3 and the hour hand 4, independently from each other. In the normal time display state, the first motor 16 is driven one step every one second so that the second hand 2 makes one revolution in 1 minute. The second motor 17 is driven one step every 10 seconds so that the minute hand 3 makes one revolution in 60 minutes and the hour hand 4 makes one revolution in 12 hours.

The RAM 21 includes a storage area 21*a* of city data. The city data is input to be set by a user through an operation section 19. The type of the received standard radio wave (e.g., Japanese standard radio wave JJY, U.S. standard radio wave WWVB, and British standard radio wave MSF) can be identified based on this city data. The method for identifying the type of the standard radio wave is not limited to the above based on the city data, but various methods are applicable. For example, also the configuration which receives a plurality of types of standard radio waves and identifies the type by searching out the standard radio wave which can be actually received can be adopted.

The ROM 22 stores a time correcting process program 22*a* for receiving the standard radio wave and automatically correcting a time, as one of control programs.

Figure 2:
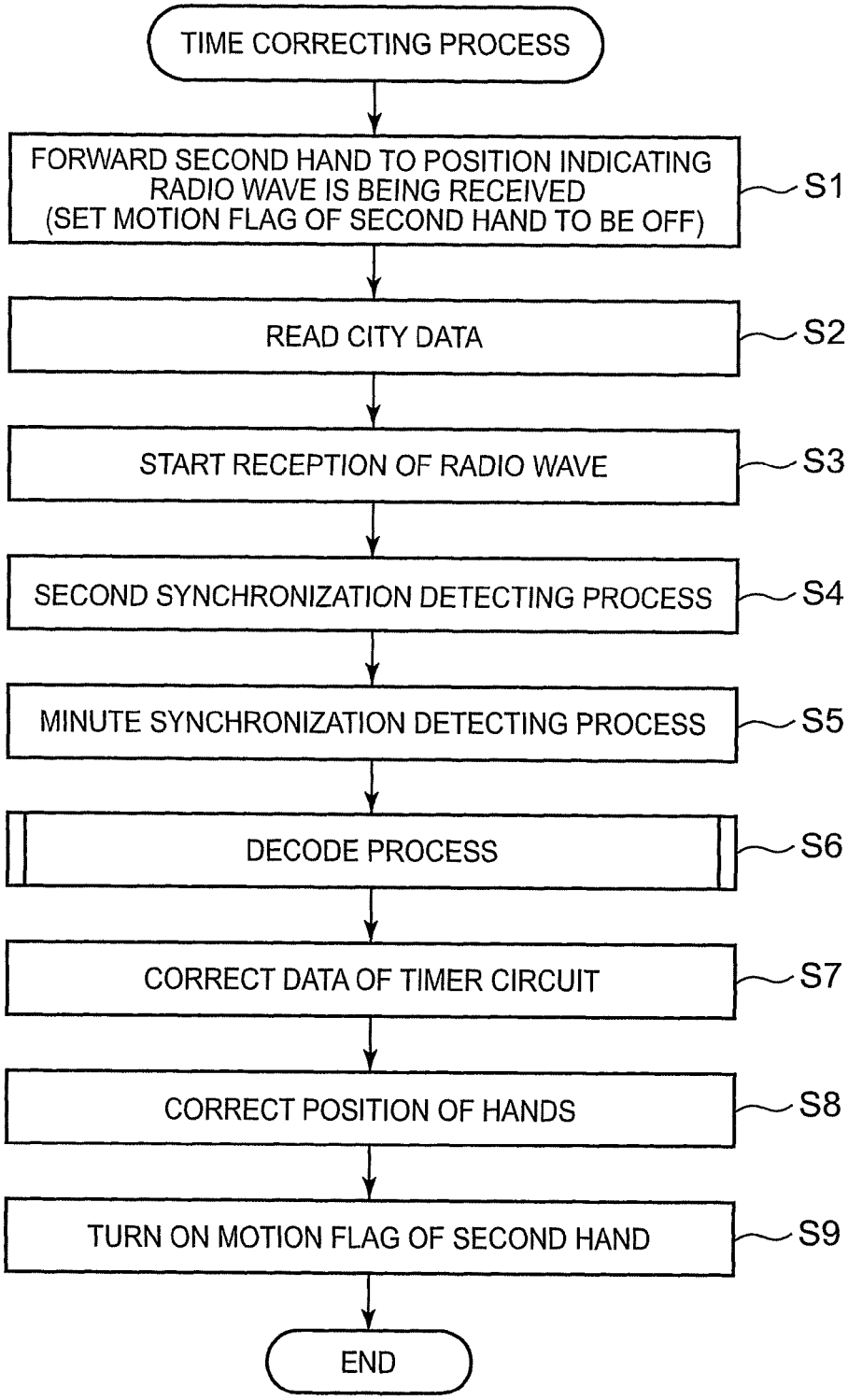
FIG. 2 is a flowchart showing a control of a time correcting process executed by a CPU.

Next, the time correcting process to be executed in the radio controlled timepiece 1 having the above-mentioned configuration will be described. FIG. 2 is a flowchart showing the time correcting process to be executed by the CPU.

The time correcting process is started on a time which is set beforehand, or when a predetermined operation command is input through the operation section 19.

During execution of the time correcting process, a motion of the second hand 2 every 1 second is stopped, while motions of the minute hand 3 and the hour hand 4 every 10 seconds are continued. When the time correcting process is started, the CPU 20 firstly fast-forwards the second hand 2 to a position which is on the face and indicates that the radio wave is being received, and sets a motion flag of the second hand 2 in the RAM 21 to be off (step S1). With this process, the process of motion of the second hand 2 every 1 second is stopped. In addition, since the time displaying process is executed in parallel with the time correcting process, the motions of the minute hand 3 and the hour hand 4 every 10 seconds are continued.

Then, the CPU 20 reads the city data from the RAM 21 in order to specify the type of the standard radio wave which can currently be received (step S2). The CPU then operates the radio wave receiving circuit 12 so as to correspond to the standard radio wave which can currently be received, thereby starting the receiving process (step S3). With this process, the standard radio wave is received, whereby the time code signal represented by high level and low level is fed from the radio wave receiving circuit 12 to the CPU 20.

When the time code signal is fed, the CPU 20 firstly executes a second synchronization detecting process (step S4) for detecting a second synchronization point (synchronization points at 0.0 second, and at 1.0 second to 59.0 seconds) from the time code signal, and a minute synchronization detecting process (step S5) for detecting a minute synchronization point (synchronization point at time of x:00 (x is an optional value).

The second synchronization detecting process in step S4 is executed as described below. Specifically, the time code signal is sampled for a plurality of seconds so as to detect a timing when a waveform change (e.g., from the high level to the low level in the case of the Japanese standard radio wave JJY) at the second synchronization point appears in 1-second periods, and this timing is determined as the second synchronization point.

In the minute synchronization detecting process in step S5, a marker pulse (a latter pulse among two continuous pulses each having a width of 200 ms) at a starting point of a frame of the time code signal is detected, and the starting point of the marker pulse is determined as the minute synchronization point.

When the second synchronization point and the minute synchronization point are detected, the CPU 20 then executes a decode process for executing a code determination of the pulse signals included in the time code signal on the basis of the detected second synchronization point and minute synchronization point to generate time information (step S6). A time information acquiring apparatus is composed of this decode process program and the CPU 20. The decode process will be described in detail later.

When the time information is acquired by the decode process, the CPU 20 corrects the timer data of the timer circuit 15 based on the time information (step S7: time correcting section). If needed, the minute hand 3 and the hour hand 4 are fast-forwarded so as to correct the hand positions (step S8). Further, the CPU turns on the motion flag of the second hand 2 to drive the stopped second hand 2 in synchronism with the timer data (step S9), and then ends the time correcting process.

Subsequently, the decode process to be executed in step S6 will be described in detail.

Figure 4:
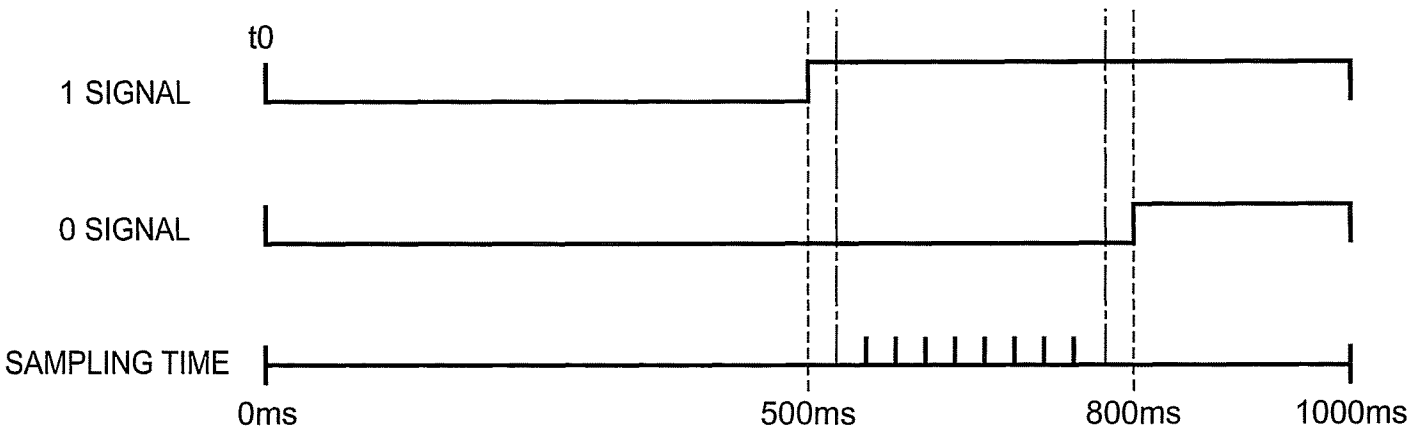
FIG. 4 is a diagram for explaining a content of a sampling process of a characteristic portion of a pulse signal.
Figure 21A:
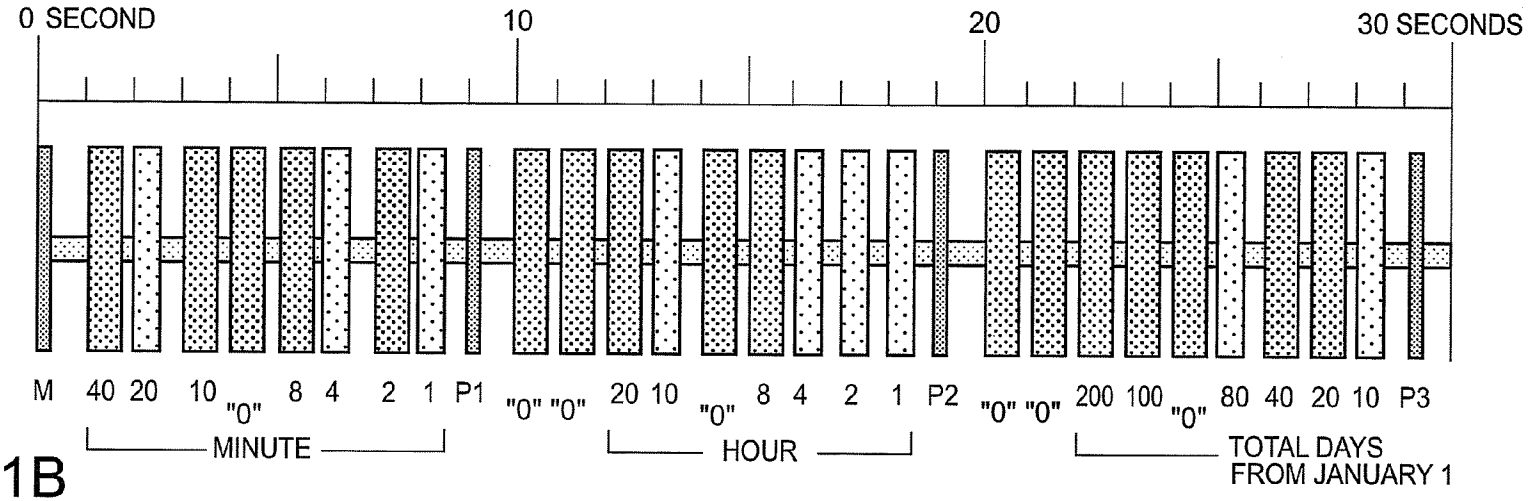
FIGS. 21A and 21B are diagrams for explaining formats of time codes in Japan.
Figure 21B:
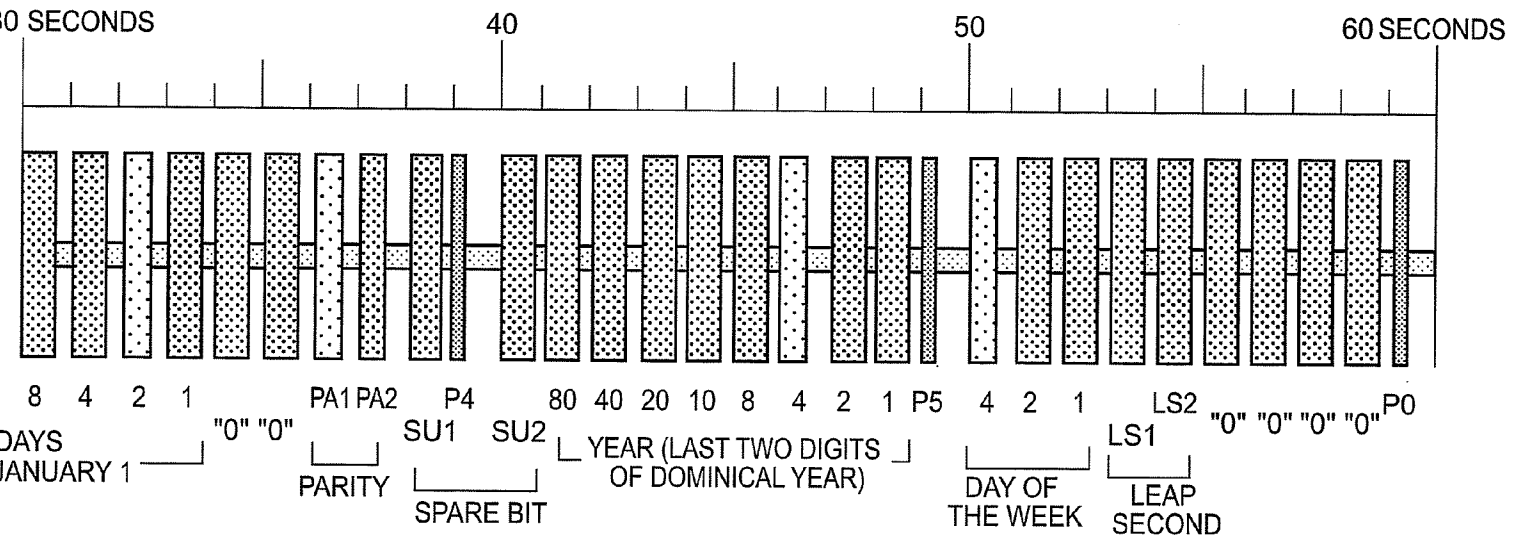

FIG. 3 is a flowchart showing a detailed control process of the decode process. FIG. 4 is a diagram for explaining a sampling process of a characteristic portion to be executed in step S11 in the decode process. FIGS. 21A and 21B are diagrams showing formats of time codes in Japan.

As shown in FIGS. 21A and 21B, in the time code included in the standard radio wave, 60 codes are arranged for every 1 second to form a code for 1 frame. At 0 second, 9 seconds, 19 seconds, . . . 59 seconds from the frame start point of the 60 codes, a marker (M) and position markers (P1 to P5, P0) indicating positions in the frame are arranged. At each of other positions, 0 code or 1 code is arranged so as to indicate minute, hour, total days, year, day-of-week, leap second, and parity of the time information.

Therefore, when proceeding to the decode process in FIG. 3, the CPU 20 firstly samples the characteristic portion of the respective pulse signals at the positions at which 0 code or 1 code is arranged (step S11: pulse measuring section: sampling section).

The characteristic portion means an interval where signal levels of a plurality of types of pulse signals to be determination subjects are different from one another. In the time code in Japan, as shown in FIG. 4, the characteristic portion is an interval where signal levels of an ideal pulse signal of 0 code (hereinafter referred to as "0 signal") and an ideal pulse signal of 1 code (hereinafter referred to as "1 signal") are different from each other, i.e. the range of 500 ms to 800 ms with the second synchronization point t0 being defined as a reference. As shown in FIG. 4, the CPU 20 detects the signal levels of the characteristic portion a plurality of times (e.g., 10 times) at predetermined sampling intervals.

After performing the sampling process to one pulse signal, the CPU stores the number of high levels and the number of low levels detected in this sampling process in the RAM 21 so as to respectively correspond to bit positions of the time codes (step S12). If there is no noise contamination, the number of the high levels is ten and the number of the low levels is zero for the pulse signal of 1 code, while the number of the high levels is zero and the number of the low levels is ten for the pulse signal of 0 code.

After storing the sampling result, the CPU 20 determines whether or not the process for 2 frames is completed (step S13). When the process is not completed, the CPU returns to step S11, and when the process is completed, the CPU proceeds to the following step. By the loop process of steps S11 to S13, the sampling process for the characteristic portion of the respective pulse signals in the range of the time code signal for 2 frames where the 0 code or 1 code is arranged is performed, and the storage of the result thereof is performed.

After the sampling process for 2 frames and the storage of the result thereof are completed, the CPU makes a determination of a code string of the time code signal by using data of the stored sampling result. The determination of the code string is made not for every individual pulse signal, but for a group including the plurality of pulse signals. Thus, the CPU 20 functions as a grouping section which groups a plurality of pulse signals included in the time code signal into one group. Specifically, 4 bits (4 bits of 05 seconds to 08 seconds from the minute synchronization point) indicating a value of units digit of minutes is specified as 1 group, and the code of this group is determined (step S14). By the processes in the subsequent steps S15, S17, S18, and S21 to S26, in addition to the process in step S14, a code string determining section which determines a probability that the code string indicated by the grouped pulse signals corresponds to an estimated code string based on a matching level is configured.

First, a process of determining the units digits of minutes indicated by 4-bit code string by a group unit will specifically be described.

Figure 5:
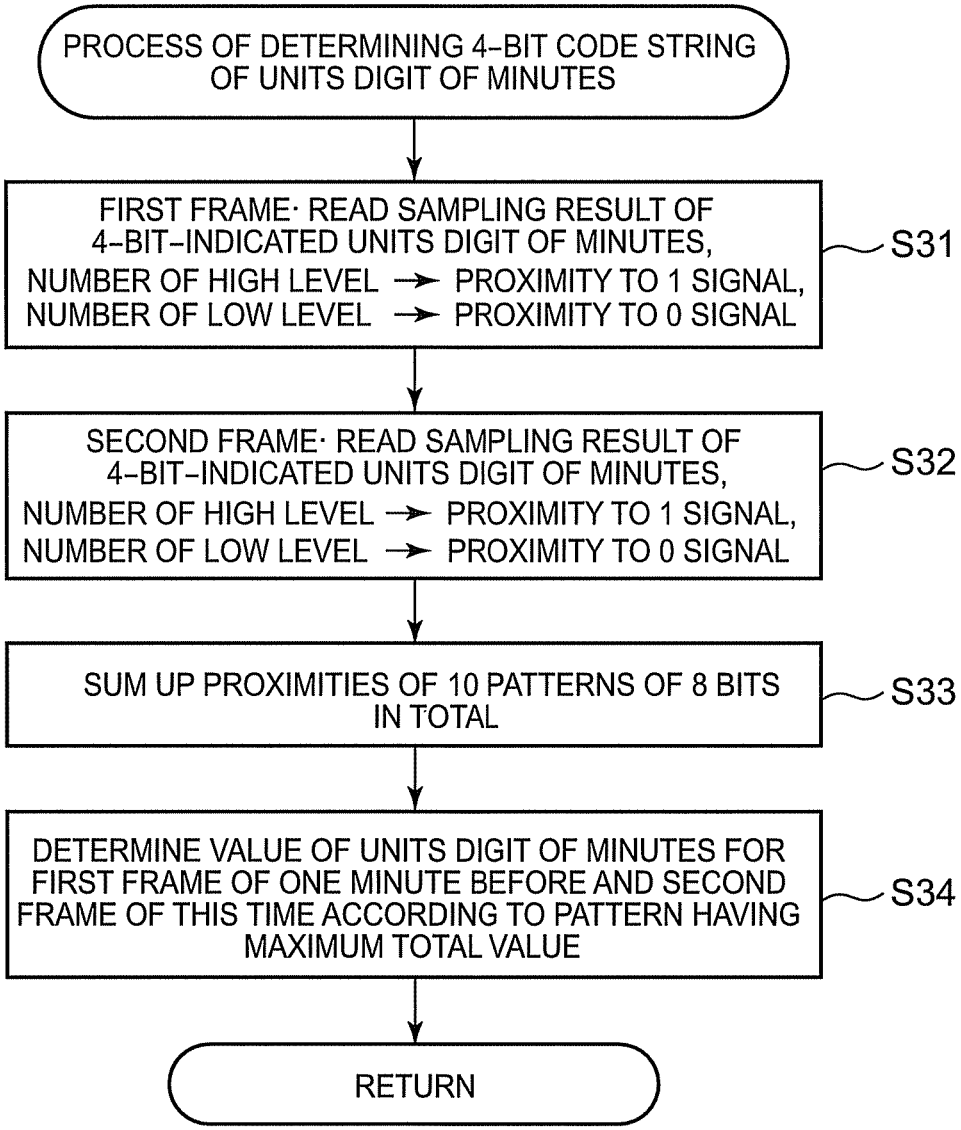
FIG. 5 is a flowchart showing a detailed process of determining units digits of minutes indicated by 4-bit code string to be executed in step S14 in FIG. 3.

FIG. 5 shows a flowchart showing the process of determining the units digits of minutes indicated by 4-bit code string in step S14.

When proceeding to the process of determining the units digits of minutes indicated by 4-bit code string, the CPU 20 reads the sampling results of the pulse signals of the 4-bit-indicated units digits of minutes (4 bits of 05 second to 08 second from the minute synchronization point) acquired by reception of the first frame from the data of the sampling result of the characteristic portion stored in the loop process in steps S11 to S13. Then, the CPU 20 sets the number of the high levels as the matching level with respect to the 1 signal, while the number of the low levels as the matching level with respect to the 0 signal, for every individual pulse signal (step S31).

Similarly, the CPU 20 then reads the sampling results of the pulse signals of the 4-bit-indicated units digits of minutes acquired by reception of the second frame, and sets the number of the high levels as the matching level with respect to the 1 signal, while the number of the low levels as the matching level with respect to the 0 signal, for every individual pulse signal (step S32).

FIGS. 6A and 6B are tables showing proximities to 0 signal or 1 signal with respect to the 4-bit-indicated units digits of minutes in an ideal time code signal having no noise, wherein FIG. 6A shows a case of a first frame received and transmitted at time of x:08, while FIG. 6B shows a case of a second frame received and transmitted at time of x:09.

The units digit of minutes indicated by 4-bit code string received and transmitted at time of x:08 is the code string of "1000" in BCD (Binary Coded Decimal) which expresses "8" in decimal notation, while the units digit of minutes indicated by 4-bit code string received and transmitted at time of x:09 is the code string of "1001" in BCD which expresses "9" in decimal notation. Therefore, as shown in FIGS. 6A and 6B, in the case of the ideal time code signal having no noise, the matching level of each pulse signal of 4 bits is such that the matching level with respect to the agreed code becomes "10", while the matching level with respect to the non-agreed code becomes "0".

FIGS. 8A and 8B are tables showing proximities to pulse signals of 0 code and 1 code with respect to the 4-bit-indicated units digits of minutes in a time code signal having noise contamination, wherein FIG. 8A shows a case of a first frame received and transmitted at time of x:08, while FIG. 8B shows a case of the second frame received and transmitted at time of x:09.

As shown in FIGS. 8A and 8B, in the case of the time code signal having the noise contamination, the matching level of each pulse signal of the 4-bit-indicated units digits of minutes is such that the matching level with respect to the agreed code becomes smaller than "10", or the matching level with respect to the non-agreed code becomes larger than "0", which means the degrees vary. As shown in a table column of "4-minute bit" in FIG. 8A, when the noise increases, there is a case where the degree of proximity with respect to the 1 signal to which the pulse signal should not agree becomes larger than the matching level with respect to the 0 signal to which the pulse signal should agree.

Accordingly, when the code determination for each bit is individually performed according to a magnitude of the matching level, the one having a larger matching level is selected in the ideal time code signal having no noise showed in FIGS. 6A and 8B, whereby it is correctly determined that the code string of the first frame is "1000", while the code string of the second frame is "1001". On the other hand, when the one having a larger matching level is selected in the time code signal having the noise contamination showed in FIGS. 8A and 8B, it may be erroneously determined that the code string of the first frame is "1101", and the code string of the second frame is "1001".

For this reason, in the decode process in the present embodiment, the code determination is not performed for every individual pulse signal, but the pulse signals are specified as 1 group, and the code strings in this group are collectively determined. Specifically, the combinations of the code strings which possibly appear in each group over 2 frames are specified as determination patterns, and values each indicating a magnitude of an event probability of each determination pattern is obtained based on the matching level with respect to each code, wherein the code string of the determination pattern having the greatest event probability is defined as the result of the determination.

FIG. 7 is a table showing the determination patterns of the code strings in the group of units digits of minutes, and the total values of the degrees of proximities in FIGS. 6A and 6B. FIG. 9 is a table showing the determination patterns of the code strings in the group of units digits of minutes, and the total values of the degrees of proximities in FIGS. 8A and 8B.

The CPU 20 functions as a code string estimating section which estimates a code string having a possibility of emerging in a portion of the group in a frame of the time code signal. Specifically, there are 10 patterns for the combinations of the code strings which might appear at 4-bit-indicated units digits of minutes, which patterns are shown in a table column of the "first frame" and a table column of the "second frame" in FIGS. 7 and 9. Specifically, the code strings in the first frame are expressed by "0, 1, 2, to 9" in decimal notation and "(0000), (0001), (0010), to (1001)" in BCD notation, and the code strings in the second frame are expressed by "1, 2, 9, 0" in decimal notation, which are obtained by adding "1" to the values of the first frame, and "(0001), (0010), (1001), to (0000)" in BCD notation. This is because the value of units digit of minutes is updated by "1" for every one frame.

Accordingly, the CPU 20 sums up the matching levels of the respective pulse signals for the corresponding code for each combination of 10-pattern code string (4 bits×2 frames =8 bits) over 2 frames, thereby acquiring the values indicating the magnitude of the event probability of each determination pattern (step S33). For example, for the determination pattern in which the first frame is "0: (0000)" and the second frame is "1: (0001)" in FIG. 7, the CPU 20 sums up the respective matching levels (see FIG. 6A) of 4 bits of the first frame with respect to the a signal, and sums up the respective matching levels (see FIG. 6B) of the high-order 3 bits of the second frame with respect to the a signal and the matching level of the low-order 1 bit with respect to the 1 signal. The result becomes "60".

The calculation described above is executed for each of the 10-pattern combinations of the code string which has a possibility of emergence. In a table column of the "total value of degrees of proximities" in FIG. 7, the total value of the degrees of proximities of only the first frame are shown in a table column of "one minute before", the total value of the degrees of proximities of only the second frame is showed in a table column of "this time", and the total value of the degrees of proximities of 2 frames is showed in a table column of "total".

After the calculation described above, the CPU 20 compares the total values of the degrees of proximities for 2 frames, thereby determining the determination pattern of the code string having the greatest value as the one having the highest event probability, and hence, determining the same as the pattern of the code string of the units degit of minutes in the received time code signal (step S34: time information generating section).

In the example of FIG. 7, since the total value of "80" is the maximum as shown by a hatching in the table, the code string pattern of this table row, which is the determination pattern having "8:(1000)" for the first frame and "9:(1001)" for the second frame, is determined as the code string of the 4-bit-indicated units digit of minutes. The sampling of 2 frames, i.e., the sampling of the frame one minute before and the frame this time, is performed, whereby "9 minutes" which is the value of the previously received second frame is determined as the value of units digit of minutes in the current time information.

As shown in FIGS. 8 and 9, there is a case where a noise is contaminated and erroneous determination might be made when the determination of the code string is performed for each pulse signal. Specifically, 4-bit-indicated units digits of minutes are specified as 1 group, and values regarding the event probability are calculated for 10 patterns of the combinations of the code string for 2 frames. With this process, as shown by the hatching in the table in FIG. 9, the total value "53" of the degrees of proximities for 2 frames is the maximum, whereby the determination pattern of the "8:(1000)" of the first frame and the "9:(1001)" of the second frame, which is the code string pattern of this table row, can be determined as the code string of 4-bit-indicated units digit of minutes.

As shown by the hatching in the table in FIG. 9, the maximum of the total value of the degrees of proximities of only the first frame is "28" for the code string of "9:(1001)". Therefore, when the code determination is performed only for the first frame, the erroneous determination might be made. However, the total of the degrees of proximities is obtained for 2 frames, so that the correct determination result is acquired.

After the determination of the code strings for the 4-bit-indicated units digits of minutes (step S14 in FIG. 3), the code strings for 3-bit-indicated tens digits of minutes (3 bits of 01 second to 03 second from the minute synchronization point) are specified as 1 group, and the code determination of this group is executed (step S15).

Figure 10:
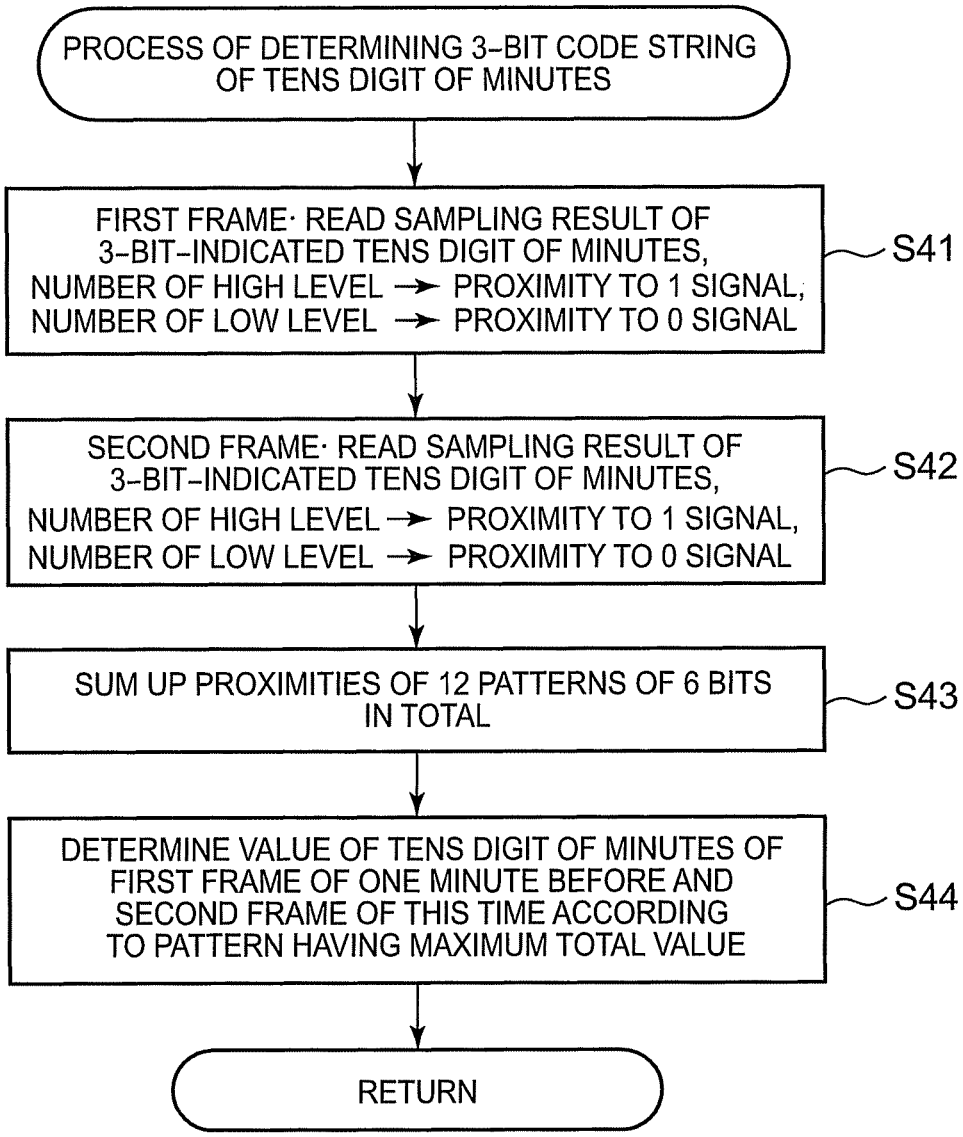
FIG. 10 is a flowchart showing a detailed process of determining tens digits of minutes indicated by 3-bit code string to be executed in step S15 in FIG. 3.

FIG. 10 is a flowchart showing the process of determining the tens digits of minutes indicated by 3-bit code string.

When proceeding to the process of determining the tens digits of minutes indicated by 3-bit code string, the CPU 20 reads the sampling results of the pulse signals of the 3-bit-indicated tens digits of minutes acquired by reception of the first frame from the data of the sampling result of the characteristic portion stored in the loop process in steps S11 to S13. Then, the CPU 20 sets the number of the high level as the matching levels with respect to the 1 signal, while the number of the low level as the matching levels with respect to the 0 signal, for every individual pulse signal (step S41).

Similarly, the CPU 20 then reads the sampling results of the pulse signals of the 3-bit-indicated tens digits of minutes acquired by reception of the second frame, and sets the number of the high level as the matching level with respect to the 1 signal, while the number of the low level as the matching level with respect to the 0 signal, for every individual pulse signal (step S42).

Then, the CPU 20 specifies the 3-bit-indicated tens digits of minutes as 1 group, and specifies the combinations of the code strings which possibly appears in each group over 2 frames as determination patterns. A value (total of degrees of proximities) indicating the magnitude of the event probability of each determination pattern is obtained based on the matching level (step S43).

FIG. 11 is a diagram for explaining a relationship between the determination patterns of the 3-bit-indicated tens digits of minutes and the determination patterns of the 4-bit-indicated units digits of minutes.

When there is no carry from the units digit of minutes, the code string which has a possibility of emerging at the 3-bit-indicated tens digits of minutes is "0 to 5" in the decimal notation, which is the same as in the first frame (one minute before) and the second frame (this time). When there is a carry from the units digit of minutes, the first frame takes "0 to 5" in the decimal notation, while the second frame takes "1 to 5, 0" which is obtained by adding 1 to each value of the first frame. These combinations are shown as 12 determination patterns on the first half (or the second half) of the table column of "tens digit of minutes" in the table showed in FIG. 11.

Accordingly, in the operation process in step S43, the CPU 20 sums up the respective degrees of proximities of the pulse signals for the corresponding code for each of 12 combinations of the code string (3 bits×2 frames=6 bits), thereby acquiring the values indicating the magnitude of the event probability of each determination pattern.

After the calculation described above, the CPU 20 acquires the magnitude of each of the event probabilities of 12 patterns through the comparison of the total values of the degrees of proximities, thereby determining the determination pattern having the greatest value as the pattern of the code string of the tens digit of minutes in the time code signal (step S44: time information generating section).

After the determination of the code string of 3-bit-indicated tens digits of minutes (step S15 in FIG. 3), consistency of the code string of the units degit of minutes and the code string of the tens digit of minutes, which have been determined so far, is checked (step S16).

As shown in correspondence relationships between the determination pattern of the "units digit of minutes" and the determination pattern of the "tens digit of minutes" indicated by arrows in FIG. 11, in the consistency check, whether good (OK) or no-good (NG) is determined depending upon the relationship between the determination result of the units digit of minutes and the determination result of the tens digit of minutes. Specifically, when there is no carry from the units digit of minutes as the determination result (when the definite value is "1 to 9"), the "determination patterns" and the "time definite values" in the first half of the table of the "tens digit of minutes" are applied. Specifically, in the pattern in which the value of the first frame (one minute before) and the value of the second frame (this time) are the same, the result of the consistency check is defined as good, and this value is determined as the value of the tens digit of minutes of the current time. When the determination result shows the pattern in which the value of the first frame and the value of the second frame are different from each other by "+1", the result of the consistency check is determined to be error.

On the other hand, when there is a carry from the units digit of minutes as the result of the determination (when the definite value is "0" as indicated by the hatching in FIG. 11), the "determination patterns" and the "time definite values" in the second half of the table of the "tens digit of minutes" are employed. Specifically, for the pattern in which the value of the first frame (one minute before) and the value of the second frame (this time) are the same, the result of the consistency check is determined to be error. When the determination result shows the pattern in which the value of the first frame and the value of the second frame are different from each other by "+1", the value of the second frame is determined as the value of the tens digit of minutes of the current time.

If the result is no good (NG) as a result of the consistency check in step S16, an error process (step S27) is performed and the decode process ends. If the result is good (OK), the CPU proceeds to the following step.

When proceeding to the subsequent step, the CPU specifies the 4-bit code string indicating the units digit of hours (4 bits of 15 seconds to 18 seconds from the minute synchronization point) as 1 group, and makes the code determination of this group (step S17). Thereafter, the CPU specifies the 2-bit code string indicating the tens digit of hours (2 bits of 12 seconds and 13 seconds from the minute synchronization point) as 1 group, and makes the code determination of this group (step S18). The method for determining the code string is the same as that in steps S14 and S15.

The CPU then performs a consistency check between the determination result of the units digit of hours and the determination result of the tens digit of hours (step S19).

FIGS. 12 and 13 are diagrams for explaining the relationship between the determination patterns of a group of tens digits of hours and the determination patterns of the group of units digits of hours. FIG. 12 shows the relationship in which there is no hour-carry (carry to hours digit), while FIG. 13 shows the relationship in which there is the hour-carry.

In the consistency check in step S19, either one of the pattern in FIG. 12 and the pattern in FIG. 13 is selectively executed based on the determinations result of the code string of the tens digit of minutes in step S15. Firstly, when the determination result of the code string of the tens digit of minutes is other than "5→0", which means there is no carry to the hours digit, the consistency check is made with the pattern showed in FIG. 12. Specifically, when the determination result shows the pattern in which the value for the first frame (one minute before) and the value for the second frame (this time) are the same in the table of the "tens digit of hours" and the table of the "units digit of hours" in FIG. 12, the result of the consistency check is determined to be good, and the values indicated in table columns of the "time definite value" are determined to be the value of units digit of hours and the value of tens digit of hours of the current time. On the other hand, when the determination result shows the pattern in which the value for the first frame (one minute before) and the value for the second frame (this time) are different from each other by "+1", or the pattern in which the units digit of hours is "9→0" or "3→0" and there is a carry to the hours digit as the determination result, the result of the consistency check is determined to be error.

On the contrary, when the tens digit of minutes is "5→0" and there is a carry to the hours digit as the determination result, the consistency check is performed with the pattern showed in FIG. 13. Specifically, when the pattern in which the value of units digit of hours for the first frame (one minute before) and the value of units digit of hours for the second frame (this time) are the same becomes the determination result, the result of the consistency check is determined to be error.

On the other hand, when the determination result shows the pattern in which the value of units digit of hours for the first frame (one minute before) and the value of units digit of hours for the second frame (this time) are different from each other by "+1", or the pattern in which the units digit of hours is "9→0" or "3→0" and there is a carry to the tens digit of hours, the CPU determines whether or not the consistency is good depending upon whether or not the determination result of the tens digit of hours corresponds to the above-mentioned determination result. Specifically, as indicated by arrows showing the correspondence relationships in FIG. 13, when the determination result of the units digit of hours is a pattern a having no carry, the result of the consistency check is determined to be good when the determination result of the tens digit of hours is a pattern A in which the first frame and the second frame have the same value. When the determination result of the units digit of hours is a pattern b of "9→0", the result of the consistency check is determined to be good when the determination result of the tens digit of hours is a pattern B of "0→1" or "1→2". When the determination result of the units digit of hours is a pattern c of "3→0", the result of the consistency check is determined to be good when the determination result of the tens digit of hours is a pattern C of "2→0". When the determination result of the units digit of hours and the tens digit of hours is other than the above-mentioned correspondence relationships, the result of the consistency check is determined to be error.

The result of the consistency check is determined to be error, when the numerical values of the tens digit of hours and the units digit of hours is "24 to 29", which must not be generated as the value for the time, based on the definite values of the tens digit of hours and the units digit of hours in the consistency check in step S19.

When the determination is no good (NG) as the result of the consistency check in step S19, the error process (step S27) is performed and the decode process ends. On the other hand, when the result is good (OK), the CPU to the following step.

When proceeding next, the CPU determines whether or not a day-carry (carry to days digit) occurs from the determination result of the time code signal up to the current stage (step S20: carry determining section, determination stop section). Specifically, as indicated by the hatching in the table in FIG. 13, when the determination result is such that the units digit of hours is "3→0" and the tens digit of hours is "2→0", the day-carry occurs, and in the other cases, the day-carry does not occur. Therefore, the CPU determines whether or not the day-carry occurs based on the determination result of the units digit of hours and the tens digit of hours.

When determining that the day-carry occurs as the determination result, the CP does not perform the determining process of the code string after that, but performs the error process (step S27) to end the decode process. On the other hand, when the CPU determines that the day-carry does not occur, it proceeds to the next determining process of the code string.

When proceeding next, the CPU sequentially executes a code determination (step S21) in which the 4-bits each indicating the units digit of total days per year (4 bits of 30 seconds to 33 seconds from the minute synchronization point) are specified as 1 group, a code determination (step S22) in which the 4-bits each indicating the tens digit of total days per year (4 bits of 25 seconds to 28 seconds from the minute synchronization point) are specified as 1 group, and a code determination (step S23) in which the 2-bits each indicating the hundreds digit of total days per year (2 bits of 22 seconds and 23 seconds from the minute synchronization point) are specified as 1 group.

FIG. 14 shows a table for explaining a relationship among the determination patterns of the group of the units digits of days, the group of the tens digits of days, and the group of the hundreds digits of days.

In the process of the code determination in steps S21 to S23, a plurality of patterns showed in a table column of the "determination pattern" in each table of FIG. 14 are employed as the determination patterns obtained by combining values which have a possibility of emerging on the corresponding plurality of bits over 2 frames. With respect to these determination patterns, the total values of the degrees of proximities are calculated, and the value of the determination pattern having the maximum total value is specified as the definite value of the corresponding digit of the current date and time.

As shown by "x" mark in each table in FIG. 14, the pattern in which the value for the first frame and the value for the second frame are different due to the carry is excluded from the determination patterns when determining the code of the units digit of days, the tens digit of days, and the hundreds digit of days. This is because, when the day-carry occurs in the determination process in step S20, the determination of the code string after which is not performed as an error. Since the determination pattern having the day-carry is excluded from the determination patterns, the number of the combinations of the determination patterns of the code strings is reduced in the code determination process of the units digit of days and the subsequent digits thereto, whereby the load of the operation process of the CPU 20 can be reduced.

When the value of 3 digits of the total days becomes "367 to 399, 000" which is unlikely as the total days per year after the code determination of each digit of the total days per year, the CPU may determine that the consistency is no good and proceed to the error process.

When finishing the code determination of each digit of the total days per year, the CPU sequentially executes a code determination (step S24) in which the 4-bits each indicating the units digit of years (4 bits of 45 seconds to 48 seconds from the minute synchronization point) are specified as 1 group, a code determination (step S25) in which the 4-bits each indicating the ten digits of years (4 bits of 41 seconds to 44 seconds from the minute synchronization point) are specified as 1 group, and a code determination (step S26) in which the 3-bits each indicating the digit of days of the week (3 bits of 50 seconds and 52 seconds from the minute synchronization point) are specified as 1 group.

FIG. 15 shows a table for explaining a relationship between the determination patterns of the group of the units digits of years and the determination patterns of the group of the tens digits of years, while FIG. 16 shows a table for explaining a determination pattern of a group of the digits of days of the week.

In the process of the code determination in steps S24 to S26, a plurality of patterns showed in a table column of the "determination pattern" in each table of FIGS. 15 and 16 are employed as the determination patterns obtained by combining values which have a possibility of emerging on the corresponding plurality of bits over 2 frames. With respect to these determination patterns, the total values of the degrees of proximities are calculated, and the value of the determination pattern having the maximum total value is specified as the definite value indicating the last two digits of the current dominical year and the day of the week.

As shown by "x" mark in each table in FIGS. 15 and 16, the pattern in which the value for the first frame and the value for the second frame are different due to the carry is excluded from the determination patterns in the code determination of the units digit of years, the tens digit of years, and the digit of days of the week. This is because, when the day-carry occurs in the determination process in step S20, the determination of the code string after which is not performed. With this process, the load of the operation process of the CPU 20 can be reduced.

After the series of the code determination is ended, the CPU ends the decode process, and then proceeds to the next step which is the time correcting process (FIG. 2). As described above, the internal time or displayed time is automatically corrected based on the acquired time information.

As described above, in the radio controlled timepiece 1 and the decode process according to the present embodiment, the matching levels each of which indicates to what degree the individual pulse signal included in the time code signal is close to the pulse signal of each code are firstly measured. The plurality of pulse signals included in the time code signal are specified as one group, and a probability that the code string indicated by the grouped pulse signals corresponds to the estimated code string is determined based on the matching level. Based on this result, the code string of this group is determined. Therefore, even when a radio wave is temporarily contaminated with a lot of noise and an error might be caused by the code determination for every individual pulse signal, it is highly possible that this error is corrected by the code determination by the group unit.

Accordingly, even in the configuration where when the error is caused in the code determination, the error is determined by the consistency check and thereby the receiving process has to be repeated again or the generation of the time information is discontinued until the next reception of the radio wave, it is highly possible that the correct code determination is performed. Consequently, the occurrence frequency of the situation in which the receiving process is repeated or the generation of the time information is discontinued until the next reception of the radio wave is reduced, whereby the correct time information can be acquired in a short period.

According to the radio controlled timepiece 1 and the decode process according to the above-mentioned embodiment, the matching level of each pulse signal is measured for the time code signal of 2 frames, and the code string having high probability is determined among the determination patterns of the code string having possibility of emerging over 2 frames. Accordingly, the determination of the code string can more correctly be performed.

According to the radio controlled timepiece 1 and the decode process according to the embodiment, when the carry is determined to occur in the units digit of days during the process of the code determination of the time code signal over 2 frames, the code determination of the units digit of days and the subsequent digits is not performed. Therefore, the determination pattern having the carry is determined to have no possibility of emerging and is excluded, when the code determination of the units digit of days and the subsequent digits is performed. Accordingly, the calculation of the total values of the degrees of proximities of the determination pattern can be skipped. Consequently, the load applied to the code determining process by the CPU 20 can be reduced.

According to the radio controlled timepiece 1 and the decode process according to the embodiment, the groups of the units digit of minutes, tens digit of minutes, units digit of hours, tens digit of hours, units digit of days, tens digit of days, hundreds digit of days, and digit of days of the week are employed as the groups to which the code determination is collectively performed. Therefore, separation between the code string having the possibility of emerging in the portion of each group and the code string having no possibility of emerging is facilitated, whereby the code determining process can be simplified.

In the embodiment, the sampling is performed to the characteristic portions of the 0 signal and the 1 signal, which are the subjects to be determined. The number of the signal levels close to the 0 signal and the number of the signal levels close to the 1 signal are counted, and the resultant is used as the matching level with respect to the 0 signal and the 1 signal. Consequently, the value indicating to what degree the pulse signal is close to the 0 signal and the 1 signal can easily and appropriately be obtained.

In the embodiment, with respect to each determination pattern of the code string having possibility of emerging in the portion of the group, the value obtained by summing up the degrees of proximities of the pulse signals with respect to the corresponding code string is calculated as the total value indicating the magnitude of the probability of becoming the code string, and the code string is determined based on the total value. Therefore, the determination of the code string of each group can easily and appropriately be performed.

The present invention is not limited to the above-mentioned embodiment, but various modifications are possible. For example, the embodiment shows the case in which the code determination is performed to the time code of the Japanese standard radio wave JJY. However, the present invention can appropriately be applied to the time code having different format as described below.

FIGS. 17 to 19 are explanatory diagrams showing examples of grouping of the code strings and the determination patterns of the code strings for the time code having a format different from the Japanese standard radio wave JJY. FIGS. 17 and 18 are explanatory diagrams showing the grouping and the determination patterns of the code strings each indicating a date with respect to a time code of DCF and MSF, which are the German standard radio wave and the British standard radio wave, while FIG. 19 is an explanatory diagram showing the grouping and a determination patterns of a code strings each indicating a day of the week with respect to a time code of DCF which is the German standard radio wave.

The time code of the standard radio waves JJY (Japan) and WWVB (The United States) employs a format in which a date is indicated by the total days per year, while the time code of the standard radio waves DCF (Germany) and MSF (the United Kingdom) employs a format in which a month and a day are indicated by an individual value. Therefore, in the standard radio waves DCF (Germany) and MSF (the United Kingdom), the bits indicating units digit of days, the bits indicating tens digit of days, the bits indicating the units digit of months, and the bits indicating the tens digit of months are respectively specified as a group to which the code string is determined, as shown in FIGS. 17 and 18. When excluding the case of the day-carry, the patterns showed in a table column of the "determination pattern" in each table are employed as the combination patterns of the code strings having the possibility of emerging in the portion of each group over 2 frames. Like the above-mentioned embodiment, the total degrees of proximities for the determination patterns are calculated, and the value of a date can be determined from the determination pattern having the maximum total value.

Moreover, the time code of the standard radio waves JJY (Japan), WWVB (The United States), and MSF (the United Kingdom) employs a format in which a day of the week is indicated by values of "0 to 6", while time code of the standard radio wave DCF (Germany) employs a format in which a day of the week is indicated by values of "1 to 7". Accordingly, in the time code of the standard radio wave DCF (Germany), the patterns showed in a table column of the "determination pattern" in each table are employed as the combination patterns of the code strings having the possibility of emerging in the portion of the group of the digits of days of the week over 2 frames, as shown in FIG. 19, when excluding the case of the day-carry. Like the above-mentioned embodiment, the total matching level for each determination pattern is calculated, and the value of the day of the week can be determined from the determination pattern having the maximum total value.

Figure 20:
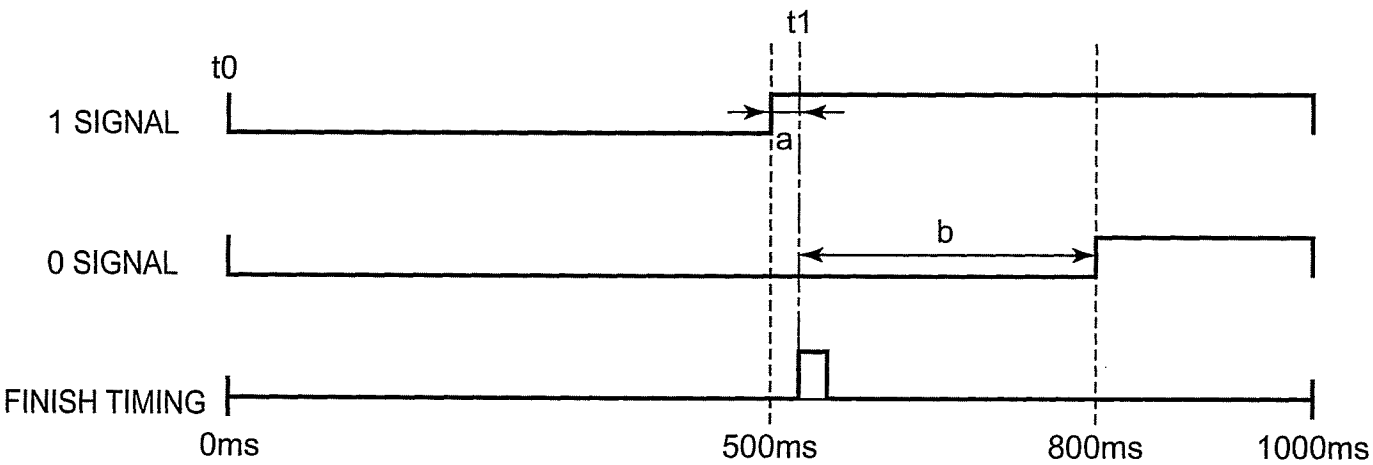
FIG. 20 is a diagram for explaining how to obtain a matching level based on a detection of a rising edge of the time code signal.

FIG. 20 is a diagram for explaining another example of a method for detecting the matching level of each pulse signal.

The above-mentioned embodiment shows the example of sampling the signal level at the characteristic portion of the 1 signal and the 0 signal in order to obtain the matching level indicating to what degree the individual pulse signal is close to the 1 signal and the 0 signal. However, the matching level can be obtained by the method showed in FIG. 20. The example in FIG. 20 corresponds to the configuration in which the change in the falling edge of the time code signal from the high level to the low level and the change in the rising edge from the low level to the high level are detected by the CPU 20. In this configuration, as shown in FIG. 20, the CPU 20 counts a time from the second synchronization point t0 to a time t1 when the rising edge of the time code signal is detected. Whether or not this time is close to 500 ms of the 1 signal or to 800 ms of the 0 signal is put into numbers by using, for example, time differences a and b between the rising time t1 of the time code signal and the rising edge of the 1 signal or the 0 signal. With this process, the matching level with respect to the 1 signal and the matching level with respect to the 0 signal may be obtained.

The above-mentioned embodiment shows the case in which the respective groups indicating each digit of the time information are employed as the group to which the determination of the code string is collectively performed. However, the grouping can be modified in various ways. For example, when the code determination is performed with a time code signal of a plurality of frames, a plurality of randomly selected bits are specified as 1 group, and the determination of the code string of the plurality of bits can be performed from the time code signal of the plurality of frames.

Further, the plurality of bits indicating each digit of the time information and parity bit may be collected to make 1 group, and the determination of the code string of this group may collectively be performed. Alternatively, after the determination of the code string, the consistency check may be performed from the value of the parity bit.

In the above-mentioned embodiment, the matching level of each pulse signal is measured from the time code signal of 2 frames, and the code string having high probability is selected from the determination patterns of the code string having possibility of emerging over 2 frames. However, a time code signal of many frames such as 3 frames or 4 frames may be used. Even in case where the code determination is performed with only a time code signal of 1 frame, it is highly possible that a correct determination result is obtained. For example, when the code determination of each pulse signal is individually made, the 4-bit-indicated units digit of minutes may erroneously be determined to be "1111 ("15" in decimal notation)", but since the event probability is compared in the code strings having possibility of emerging, it is correctly determined to be "0111 ("7" in decimal notation)". When an erroneous determination is made, the error is caused by the consistency check and the measure of the re-reception or the discontinuation of the acquisition of the time information until next time is taken. Therefore, it is beneficial that there is a high possibility that the correct determination result is obtained even when there is a possibility of the erroneous determination.

In the above-mentioned embodiment, when a code is determined to be the code by which the day-carry occurs from the time code signal of the plurality of frames, the code determination for this digit and subsequent digits is discontinued so as to reduce the load of the operation for the code determination. However, the condition such that a carry occurs in the tens digit of minutes, units digit of hours, tens digit of hours, or tens digit of days may be employed as the condition for discontinuing the code determination.

All of the disclosures including the patent specification, the claims, the attached drawings and the abstract of Japanese Patent Application No. 2010-153518 filed on Jul. 6, 2010 are herein incorporated by reference.

What is claimed is:

1. A time information acquiring apparatus for acquiring time information from a time code signal included in a standard radio wave, comprising:

a pulse measuring section which detects a matching level of an individual pulse signal constituting the time code signal to a predetermined code value;

a grouping section which groups a plurality of pulse signals included in the time code signal into one group;

a code string estimating section which estimates a code string having a possibility of emerging in a portion of the group in a frame of the time code signal;

a code string determining section which determines a probability that the code string indicated by the grouped pulse signals corresponds to the estimated code string based on the matching level; and a time information generating section which generates the time information based on the code string for which the code string determining section determines that the probability is high, wherein the pulse measuring section detects the matching level of the individual pulse signal for a plurality of frames of the time code signal, and the code string estimating section estimates a code string having a possibility of emerging in the portion of the group in the frame of the time code signal over the plurality of frames; and wherein the code string determining section is configured to determine the probability that the code string indicated by the grouped pulse signals corresponds to the estimated code string by adding the matching level of the estimated code string to the matching level of a second estimated code string.

2. The time information acquiring apparatus according to claim 1, further comprising:

a carry determining section which determines whether or not the time code signal of the plurality of frames steps over a timing at which a predetermined one of digit values of tens digit of minutes, units digit of hours, tens digit of hours, units digit of days, and tens digit of days is carried; and a determination stop section which discontinues determination by the code string determining section when the carry determining section determines that the time code signal steps over the timing at which the predetermined one of digit values is carried.

3. A radio controlled timepiece comprising:

a counting section which counts a time;

a radio wave receiving section which receives a standard radio wave to demodulate the time code signal;

the time information acquiring apparatus according to claim 2; and a time correcting section which corrects the counted time in the counting section based on the time information acquired by the time information acquiring apparatus.

4. The time information acquiring apparatus according to claim 1, wherein the group includes a group of a code portion indicating units digit of minutes, a group of a code portion indicating tens digit of minutes, a group of a code portion indicating units digit of hours, a group of a code portion indicating tens digit of hours, a group of a code portion indicating units digit of total days per year, and a group of a code portion indicating tens digit of total days per year.

5. A radio controlled timepiece comprising:

a counting section which counts a time;

a radio wave receiving section which receives a standard radio wave to demodulate the time code signal;

the time information acquiring apparatus according to claim 4; and a time correcting section which corrects the counted time in the counting section based on the time information acquired by the time information acquiring apparatus.

6. The time information acquiring apparatus according to claim 1, wherein the pulse measuring section includes a sampling section which detects signal levels of the time code signal at a plurality of timings within a characteristic interval where signal levels of a plurality of types of the pulse signals each of which is a determination subject are different from one another, and wherein the number of signal levels which is close to one of the pulse signals as the determination subject among the signal levels at the plurality of timings detected by the sampling section is obtained as the matching level with respect to the one of the pulse signals as the determination subject.

7. The time information acquiring apparatus according to claim 6, wherein the code string determining section calculates a value obtained by summing up the matching level of the individual pulse signal of the time code signal with respect to each of the code strings having a possibility of emerging in the portion of the group in the frame of the time code signal, as a total value indicating a magnitude of a probability that the indicated code string becomes the each of the code strings, and determines which of the code strings the indicated code string becomes with a high probability based on the total value.

8. A radio controlled timepiece comprising:

a counting section which counts a time;

a radio wave receiving section which receives a standard radio wave to demodulate the time code signal;

the time information acquiring apparatus according to claim 7; and a time correcting section which corrects the counted time in the counting section based on the time information acquired by the time information acquiring apparatus.

9. A radio controlled timepiece comprising:

a counting section which counts a time;

a radio wave receiving section which receives a standard radio wave to demodulate the time code signal;

the time information acquiring apparatus according to claim 6; and a time correcting section which corrects the counted time in the counting section based on the time information acquired by the time information acquiring apparatus.

10. A radio controlled timepiece comprising:

a counting section which counts a time;

a radio wave receiving section which receives a standard radio wave to demodulate the time code signal;

the time information acquiring apparatus according to claims 1; and a time correcting section which corrects the counted time in the counting section based on the time information acquired by the time information acquiring apparatus.

* * * * *